US012274327B2

(12) United States Patent
Wehrmeyer

(10) Patent No.: US 12,274,327 B2
(45) Date of Patent: Apr. 15, 2025

(54) ADJUSTABLE HEEL STRAP SYSTEM

(71) Applicant: Wolverine Outdoors, Inc., Rockford, MI (US)

(72) Inventor: Brenton Scott Wehrmeyer, Grand Rapids, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 18/131,890

(22) Filed: Apr. 7, 2023

(65) Prior Publication Data

US 2024/0334999 A1 Oct. 10, 2024

(51) Int. Cl.

| | |
|---|---|
| ***A43B 3/12*** | (2006.01) |
| ***A43C 11/12*** | (2006.01) |
| ***A43C 11/14*** | (2006.01) |
| ***A43C 11/22*** | (2006.01) |

(52) U.S. Cl.

CPC ..... *A43B 3/126* (2013.01); *A43C 11/12* (2013.01); *A43C 11/1493* (2013.01); *A43C 11/22* (2013.01)

(58) Field of Classification Search

CPC ..... A43B 3/122; A43B 3/126; A43B 11/00; A43C 11/00; A43C 11/22

See application file for complete search history.

(56) References Cited

U.S. PATENT DOCUMENTS

| | | | | | |
|---|---|---|---|---|---|
| 5,465,506 | A * | 11/1995 | Matis | A43C 11/00 | D2/916 |
| 5,651,195 | A * | 7/1997 | Clancy | A43C 1/00 | 36/11.5 |
| 5,657,557 | A * | 8/1997 | Hull | A43C 7/00 | 36/50.1 |
| 8,695,233 | B2 * | 4/2014 | Youngs | A43B 23/0235 | 36/109 |
| 2007/0011914 | A1 * | 1/2007 | Keen | A43B 5/08 | 36/50.1 |
| 2007/0022629 | A1 * | 2/2007 | Bathum | A43B 13/16 | 36/11.5 |
| 2007/0283594 | A1 * | 12/2007 | Sink | A43B 3/126 | 36/11.5 |
| 2012/0047769 | A1 * | 3/2012 | Hill | A43B 3/126 | 36/97 |
| 2014/0130372 | A1 * | 5/2014 | Aveni | A43B 3/128 | 36/83 |

(Continued)

*Primary Examiner* — Patrick J. Lynch

(74) *Attorney, Agent, or Firm* — Warner Norcross + Judd LLP

(57) ABSTRACT

An adjustable elastic heel strap having first and second elastic closure elements that cooperate to adjustably close the heel. The first elastic closure element is elastic and may be manufactured from a length of elastic webbing. The first elastic closure element may be arranged to engage the wearer's foot. The second elastic closure element is elastic and may be manufactured from an elastic cord. The second elastic closure element may include a cord lock that allows a wearer to selectively vary the effective length and elastic tension of the heel strap. The second elastic closure element may be disposed along the outside of the first elastic closure element to facilitate access. The heel strap may also include a heel pull that is affixed to the first elastic closure element. The heel strap may also include upper and lower retainers that retain and guide the elastic cord and the cord lock.

10 Claims, 5 Drawing Sheets

(56) References Cited

U.S. PATENT DOCUMENTS

| | | | | |
|---|---|---|---|---|
| 2016/0113350 | A1* | 4/2016 | Sashen | A43B 3/126 36/11.5 |
| 2016/0343240 | A1* | 11/2016 | Chuang | A43C 11/00 |
| 2017/0105486 | A1* | 4/2017 | Klein | A43B 23/025 |
| 2018/0249787 | A1* | 9/2018 | Fuerst, Sr. | A43B 1/04 |
| 2019/0320755 | A1* | 10/2019 | Opalacz | A43B 3/126 |
| 2020/0138145 | A1* | 5/2020 | Greenspan | A43C 1/003 |
| 2020/0268106 | A1* | 8/2020 | Blanche | A43B 23/0275 |
| 2021/0145126 | A1* | 5/2021 | Sola | A43C 1/00 |
| 2023/0210218 | A1* | 7/2023 | Pence | A43B 1/10 36/11 |

* cited by examiner

ADJUSTABLE HEEL STRAP SYSTEM

BACKGROUND OF THE INVENTION

The present invention relates to footwear and more particularly to footwear in which the upper incorporates a heel strap, such as sandals.

Sandals are available in a variety of different types and styles, many of which are customized to serve different functions. One type of sandal that is particularly popular in today's commercial market is a sport sandal. Despite the name, sports sandals are commonly used for a wide range of activities and are not limited to use in sporting activities. Conventional sport sandals may include a contoured sole and a strapping system for retaining the sole against the bottom of a foot. Although strapping systems vary from sandal to sandal, many typical sports sandals include a front strap for retaining the forefoot, and ankle and heel straps that cooperatively retain the rear portion of the foot. The design and configuration of the straps may vary significantly from sandal to sandal.

It is common for the heel strap to be adjustable in length to permit the sandal to be adjusted to not only allow the strap to snuggly fit different size feet, but also to help position the foot properly on the sole. The ankle posts typically provide a certain degree of rigidity, and the heel strap (and other straps) can be attached to the ankle posts or directly to the sole. The straps may be attached to the ankle posts by stitching, riveting, or stapling, and/or can be embedded or adhered within the sole. For example, it is not uncommon for each ankle post to terminate in an attachment ring to which the heel strap and other straps may be attached. In many applications, opposite ends of the heel strap are looped around the attachment rings and sewn back onto themselves to secure the heel strap to the ankle posts at opposite ends. To allow adjustability, the heel strap may include a first end that is fixed to one ankle post and an a second end that is adjustably secured to the opposite ankle post. For example, a number of conventional ankle straps include a free end that is thread through a loop affixed to one of the ankle posts and then folded back onto itself and secured by a hook-and-loop fastener, a buckle or other adjustable attachment structure. In use, the wearer can vary the degree of overlap in the heel strap to adjust the length of the heel strap.

Despite the adjustability already available in some conventional heel straps, consumers may benefit from further improvements in the field of heel straps, particularly in the context of sandals that may be used in sporting activities. As a result, there remains a need for an improved heel strap that facilitates entry into the sandal, provides a secure fit and is readily adjustable to meet a range of needs.

SUMMARY OF THE INVENTION

As article of footwear is provided with an adjustable heel strap having a pair of elastic closure elements that work cooperatively to provide an adjustable elastic heel closure. The first elastic closure element includes a first end joined to the lateral ankle post and a second end joined to the medial ankle post. The second elastic closure element is adjustable in length and includes a first end joined to the lateral ankle post and a second end joined to the medial ankle post. In use the second elastic closure element is adjustable by the user to selectively control the fit of the adjustable heel strap. For example, the second elastic closure element may be lengthened (or loosened) to facilitate entry of the foot into the sandal and then shortened (or tightened) to secure the sandal on the foot.

In one embodiment, the first elastic closure element is fixed in length and is non-adjustable. The first elastic closure may be formed from a length of elastic webbing. The width of the elastic webbing may vary from application to application, but may be in the range of ¾ inch to 1 inch, or in the range of ½ inch to 1½ inch in typical applications.

In one embodiment, the adjustable heel strap of the present invention is incorporated into a sandal. In one embodiment, the sandal includes a sole and a pair of ankle posts extending up from the sole toward opposite lateral sides of the sole in the ankle region. The sandal includes a forefoot strap. In alternative embodiments, the adjustable heel strap may be incorporated into other types of footwear that include a heel strap. In alternative embodiments, opposite ends of the adjustable heel strap may be affixed to the medial and lateral sides of the upper.

In one embodiment, the first elastic closure element is a length of elastic webbing having a first end affixed directly or indirectly to the lateral ankle post by stitching and a second end affixed directly or indirectly to the medial ankle post by stitching.

In one embodiment, the heel strap includes at least one webbing stub that extends from the ankle post. In one embodiment, the heel strap includes a medial webbing stub and a lateral webbing stub. Each webbing stub may be formed by a short segment of webbing, such as a nylon webbing or other material with similar properties. The webbing stubs may be formed from a non-elastic material. In some applications, the webbing stubs may be separately manufactured and affixed to the ankle posts. In other applications, the webbing stubs may be replaced by corresponding structure that is integral with the ankle posts.

In one embodiment, each ankle post includes an attachment ring. The medial webbing stub may be joined to the medial attachment ring. The lateral webbing stub may be joined to the lateral attachment ring. The size, shape and configuration of the attachment rings may vary from application to application. In alternative applications, one or both of the attachment rings may be eliminated, and the webbing stubs or heel straps may be affixed to the ankle posts using other attachments.

In one embodiment, the first elastic closure element includes a first end joined to the medial webbing stub, for example, by stitching and a second end joined to the lateral webbing stub, for example, by stitching. In one embodiment, opposite ends of the first elastic closure element overlap the corresponding webbing stubs and are secured in the overlapped regions by stitching. The first elastic closure element may be arranged to directly engage the heel of the wearer's foot.

In one embodiment, the second elastic closure element is disposed adjacent to the first closure element and is adjustable to vary the overall elastic tension in the adjustable heel strap. In one embodiment, the second elastic closure element extends between the medial ankle post and the lateral ankle post in parallel with the first elastic closure element.

In one embodiment, the second elastic closure element includes an elastic cord. The elastic cord may be arranged in a loop that joins the lateral and medial ankle posts. In one embodiment, the elastic cord loops through the webbing stubs on opposite sides of the heel. For example, each webbing stub may be folded over and sewn onto itself to define a webbing loop through which the elastic cord passed.

In one embodiment, the elastic cord includes a cord lock that allows the wearer to selectively adjust the effective size of the elastic cord. By decreasing the effective size of the elastic cord, the length of the heel strap can be shortened and the elastic tension in the heel strap can be increased. Similarly, by increasing the effective size of the elastic cord, the heel strap can be lengthened and the elastic tension in the heel strap can be reduced.

In one embodiment, the heel strap includes a heel pull affixed to the approximate center of the first elastic closure element. For example, the heel pull may be a section of webbing sewn to the first elastic closure element. The heel pull may extend above and below the first elastic closure element. In one embodiment, the heel pull may be formed from a length of nylon webbing that is folded onto itself and extends above and below the first elastic closure element. The heel pull may define an upper loop that can be grasped and pulled by the user when manipulating the strap, for example, when pulling the heel strap onto or off of the foot. The heel pull may also define a lower loop that helps to guide and retain the second elastic closure element. For example, the second elastic closure element may pass through the lower loop. In use, the lower loop retains the second elastic closure element so that it moves with the adjustable heel strap and helps to prevent it from sliding up or down onto wearer's foot.

In one embodiment, the adjustable heel strap includes an upper retainer that holds the second elastic closure element. In one embodiment, the upper retainer includes a loop of cord that is secured to the heel pull. The upper retainer may include small loops disposed on opposite sides of the heel pull and the second elastic closure element may pass though the loops. The cord lock may be positioned on the second elastic closure element between the two upper retainer loops. The upper retainer helps to hold the cord lock in place making it easier to find and prevent the lace lock from directly engaging the wearer's foot.

The present invention provides a simple and effective adjustable elastic heel strap that is easily adjustable to provide the desired level of elastic tension in the heel strap. A fixed-length nonadjustable first elastic closure can be configured to provide sufficient elastic tension for the footwear to be easily slipped on and off and worn for casual use without tightening the second elastic closure. When desired, the second elastic closure element may be adjusted to shorten the heel strap and increase the elastic tension in the strap. In those applications in which the first elastic closure is a length of elastic webbing, the elastic webbing provides comfortable engagement with the wearer's foot. The second elastic closure element may be configured as a loop of elastic cord that can be quickly and easily lengthened and shortened through the use of a cord lock. When incorporated, the upper retainer retains the second elastic closure element and helps to ensure that the cord lock remains centered on the heel strap where it is readily accessible to the wearer. The upper retainer may be a loop of cord or string through which the elastic cord can be easily threaded. When incorporated, the heel pull may includes a lower retainer that retains the second elastic closure element to further couple the second elastic closure to the heel strap. The heel pull may define a loop so that the second elastic closure can be easily fed through the loop.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Figure 1:
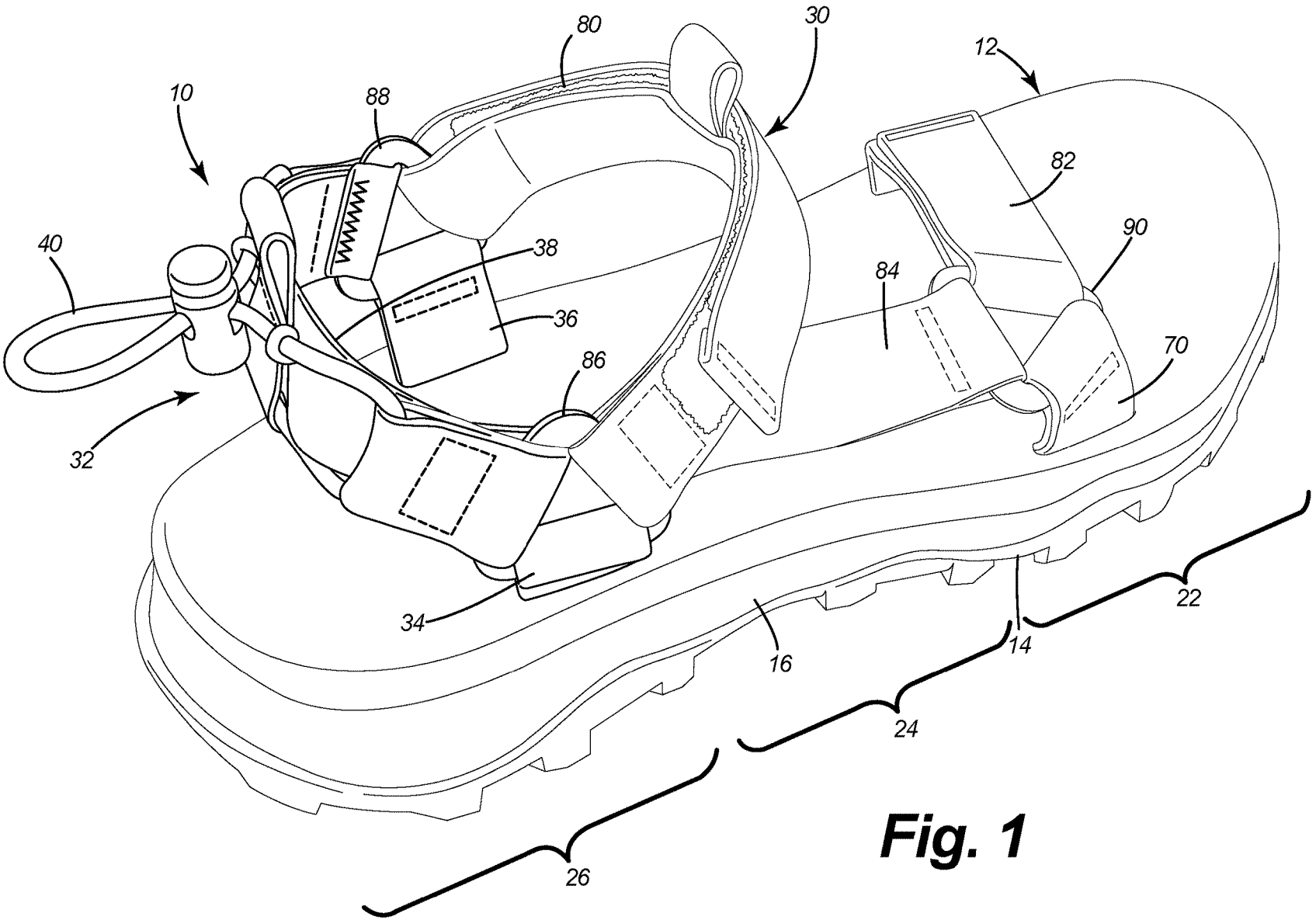
FIG. 1 is a perspective view of a sandal incorporating an adjustable elastic heel strap in accordance with an embodiment of the present invention.

A sandal including an adjustable heel strap constructed in accordance with an embodiment of the present invention is shown in FIG. 1 and generally designated 10. In general, the sandal 10 includes a sole assembly 12 and a strap system 30. The sole assembly 12 of the illustrated embodiment includes an outsole 14 and a midsole 16. The strap system 30 of this embodiment includes a series of straps that overlie the forefoot, wrap about the front of the ankle, and around the rear of the heel to cooperatively retain a wearer's foot on the sole assembly 12. The strap system 30 includes an adjustable elastic heel strap 32 that includes a first elastic closure element 38 and a second elastic closure element 40 that cooperate to retain the heel of the wearer's foot. In the illustrated embodiment, the first elastic closure element 38 wraps about the heel of the wearer's foot and is non-adjustable. The second elastic closure element 40 is adjustable to allow a wearer's to selectively adjust the length and/or elastic tension of the heel strap 32.

The sandal 10 of FIG. 1 is merely exemplary and the various aspects of the present invention may be incorporated into a wide range of alternative footwear constructions that includes a heel strap. This includes other sandal constructions, including sandals with alternative strap configurations, alternative sole constructions and/or alternative upper constructions. It may also include mules, clogs and other articles of footwear in which a heel strap is desired. The illustrated sandal 10 is intended to be worn on the right foot and will be described in detail. Of course, a sandal intended to be worn on the left foot may be a mirror image of the illustrated sandal 10. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations.

Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "ankle region" (or ankle or heel) refers generally to that portion of the footwear rearward of the arch region corresponding to the ankle and/or heel of the wearer's foot. The forefoot region 22, arch region or mid-foot region 24, and ankle or heel region 26 generally are identified in FIG. 1. The sole assembly 12 and strap system 30 each have a corresponding forefoot portion, arch region or mid-foot portion, and ankle portion within these regions 22-26. However, it is to be understood that delineation of these regions may vary depending upon the configuration of the sole assembly and/or footwear.

As noted above, the sandal 10 of FIG. 1 generally includes a sole assembly 12 and a strap system 30 that are interconnected. The sole assembly 12 defines a foot-shaped perimeter and can include one or more different components, such as a midsole 16 configured to mirror the shape of the undersurface of a typical wearer's foot. In this embodiment, the outsole 14 forms the ground-engaging layer of the sandal 10. The outsole 14 of FIG. 1 is generally conventional and is made of conventional outsole materials (such as rubber or a rubber compound) that are selected to provide the desired balance between comfort, wear, and traction. Although the outsole 14 may be manufactured from a conventional rubber compound, a variety of other materials may be used to provide the desired comfort, wear, and traction. The bottom surface of the outsole 14 may include treads, lugs, spikes, cleats, and/or other features designed to enhance traction. The design and configuration of the outsole 14 may vary from application to application as desired. Generally, regardless of which components are present, the sole assembly 12 can form the bottommost portion of the sandal 10.

The sandal 10 includes a strap system 30 that includes an adjustable ankle strap 80, an adjustable forefoot strap 82 and an adjustable heel strap 32. The adjustable heel strap 32 and ankle strap 80 are attached to a pair of generally upright lateral and medial ankle posts 34 and 36 extending upwardly along respective sides of the sole assembly 12 in the ankle region 26. The bottom end portions of the ankle posts 34, 36 are anchored to the sole assembly 12 and may be sandwiched between the outsole 14 and the midsole 16, or cemented to the midsole 16 or the outsole 14, for example. In illustrated embodiment, the upper end of each ankle post 34, 36 ends in an attachment ring 86, 88. The attachment rings 86, 88 of the illustrated embodiment are generally triangular in shape. In this configuration, each attachment ring 86, 88 include three linear segments that facilitate attachment of three straps to each attachment ring 86, 88. For example, in the illustrated embodiment, each ankle post attachment ring 86, 88 receives the ankle post 34, 36, the adjustable heel strap 32 and the ankle strap 80. The size, shape and configuration of the attachment rings may vary from application to application, as desired. In this embodiment, the ankle posts 34, 36 are formed from one or more lengths of webbing. For example, both ankle posts 34, 36 may be manufactured from a single length of webbing that is doubled-up on opposite sides of the sandal 10 and is fitted through an attachment ring 86, 88 on each side to form the two ankle posts 34, 36. The doubled-up segments are sewn to one another to secure the attachment rings 86, 88. In this configuration, the free ends of the webbing and the section of webbing that spans between the two ankle posts is secured beneath the midsole. As an alternative example, each ankle post 34, 36 can be manufactured from a separate length of webbing. In this configuration, each length of webbing is fitted through the corresponding attachment ring 86, 88, doubled over and then sewn onto itself. The free ends of the webbing are secured beneath the midsole. Other conventional methods such as adhesive, riveting, or stapling may be used to attach the webbing to itself. In alternative applications, the attachment rings may be eliminated and the adjustable heel strap, the ankle strap and the connecting strap can be connected to the ankle posts using other attachment structures. For example, one or more of the straps may be sewn or otherwise attached directly the appropriate ankle post(s). As another example, the ankle posts may include slits, grommets or other similar openings through which the one or more of the straps may be secured to the ankle posts.

The ankle strap 80 of the illustrated embodiment includes a lateral end that is fixedly joined to the attachment ring 86 of the lateral ankle post 34. For example, in this embodiment, the ankle strap 80 is formed from a length of webbing. The lateral end of the ankle strap 80 passes through the lateral attachment ring 86, is folded back onto itself and sewn together in the overlap region to fixedly attach the lateral end of the ankle strap 80 to the lateral ankle post 34. Other conventional methods such as adhesive, riveting, or stapling may be used to attach the strap to itself. On the medial side of the sandal 10, the free end of the ankle strap 80 is fitted through the attachment ring 88 on the medial ankle post 36 and is folded back onto itself and adjustably secured to itself by a hook-and-loop fastener, such as Velcro® brand hook-and-loop fastener. In use, the wearer can adjust the position at which the ankle strap 80 is attached to itself to vary the effective length of the ankle strap 80.

In the illustrated embodiment, the strap system 30 includes a forefoot strap 82 connected directly to the sole on the medial side and adjustably affixed to the sole on the lateral side by a lateral forefoot post 70. The medial end of the forefoot strap—may be anchored to the sole in essentially any desired way, however, in the illustrated embodiment, the medial end of the forefoot strap 82 may be sandwiched between the outsole 14 and the midsole 16, or cemented to the midsole 16 or the outsole 14, for example.

The forefoot strap 82 extends upwardly from the medial side of the sole assembly 12 and extends laterally across the sole assembly 12 in the forefoot region 22. The lateral forefoot post 70 includes a bottom end portion that is sandwiched between the outsole 14 and the midsole 16, for example, or may be cemented to the midsole 16 or the outsole 14. The upper end of the lateral forefoot post includes an attachment ring 90, which may be attached to the lateral forefoot post in essentially the same manner as discussed above in connection with the ankle posts and their associated attachment rings. In alternative applications, the forefoot strap 82 can be secured to the forefoot post 70 using alternative attachment structures. In this embodiment, the forefoot strap 82 is fitted through an attachment ring 90, folded back onto itself and adjustably affixed to itself. For example, in the illustrated embodiment, the forefoot strap 82 includes a hook and loop fastener arrangement that allows the folded portion of the forefoot strap 82 to be attached to itself at different locations to allow the wearer to selectively vary the effective length of the forefoot strap 82.

In the illustrated embodiment, the forefoot strap 82 and the ankle strap 80 are adjustable through the use of hook-and-loop fastener arrangements. The forefoot strap 82 and the ankle strap 80 may include alternative length-adjustment mechanisms or they may be non-adjustable (e.g., fixed length or elastic). For example, the forefoot strap 82 and/or the ankle strap 80 could alternatively include a buckle (not shown) for adjusting effective length.

In the illustrated embodiment, the strap system 30 also includes a connecting strap 84 that joins the medial end of the ankle strap 80 to the lateral forefoot post 70. The connecting strap 84 may be eliminated in alternative embodiments. In the illustrated embodiment, the connecting strap 84 is a fixed length of webbing having a first end attached directly to the ankle strap 80, for example, by stitching, and a second end attached to the attachment ring 90 on the lateral forefoot post 70. For example, the second end of the webbing may be fitted through the attachment ring 90, folded back onto itself and then sewn together. In alternative embodiments, the connecting strap 84 can be configured to have an adjustable length.

The illustrated ankle strap 80, forefoot strap 82 and connecting strap 84 are merely exemplary and the present invention may be implemented in sandals having other strap systems, including other ankle and forefoot strap arrangements. Further, the adjustable heel strap 32 of the present invention can be incorporated into footwear other than sandals, such as mules, clogs and other footwear where an adjustable heel strap is desired. In alternative applications that incorporate different uppers, the adjustable heel strap is attached to the upper using essentially any suitable structure. For example, opposite ends of the adjustable heel strap may be attached to attachment rings joined with the upper or opposite ends of the heel strap may be joined directly to the upper by stitching or other attachment methods. In some applications, the upper may include integrated structure that takes the place of the webbing stubs of the illustrated embodiment.

In the illustrated embodiment, the sandal upper is manufactured from various straps that are manufactured from webbing, such as woven nylon, polyester or polypropylene webbing. The upper may, however, be manufactured from other materials, such as leather, canvas or a variety of other materials or combinations of materials.

Figure 2:
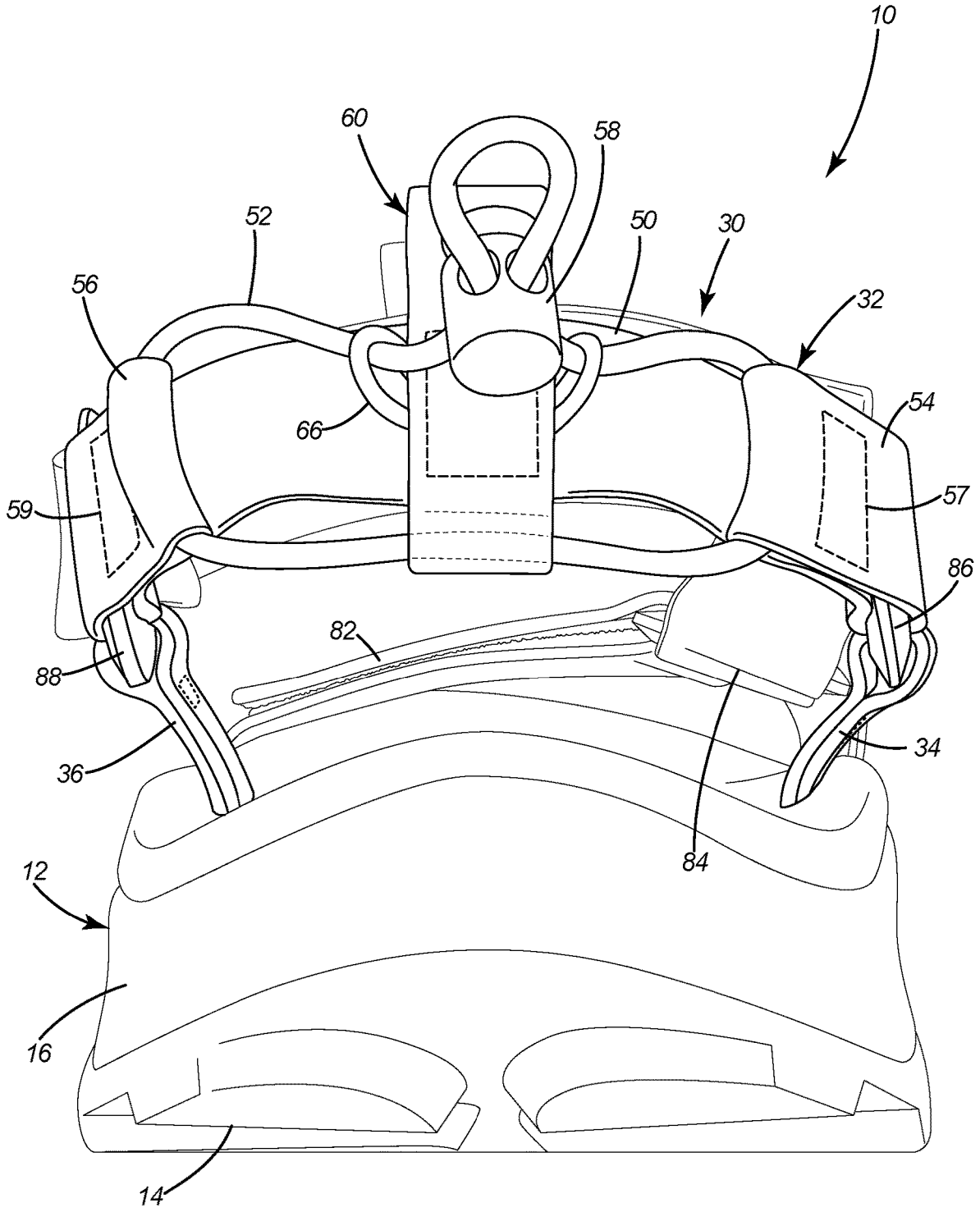
FIG. 2 is a rear view of the sandal with the second elastic closure element in a relaxed state.
Figure 3:
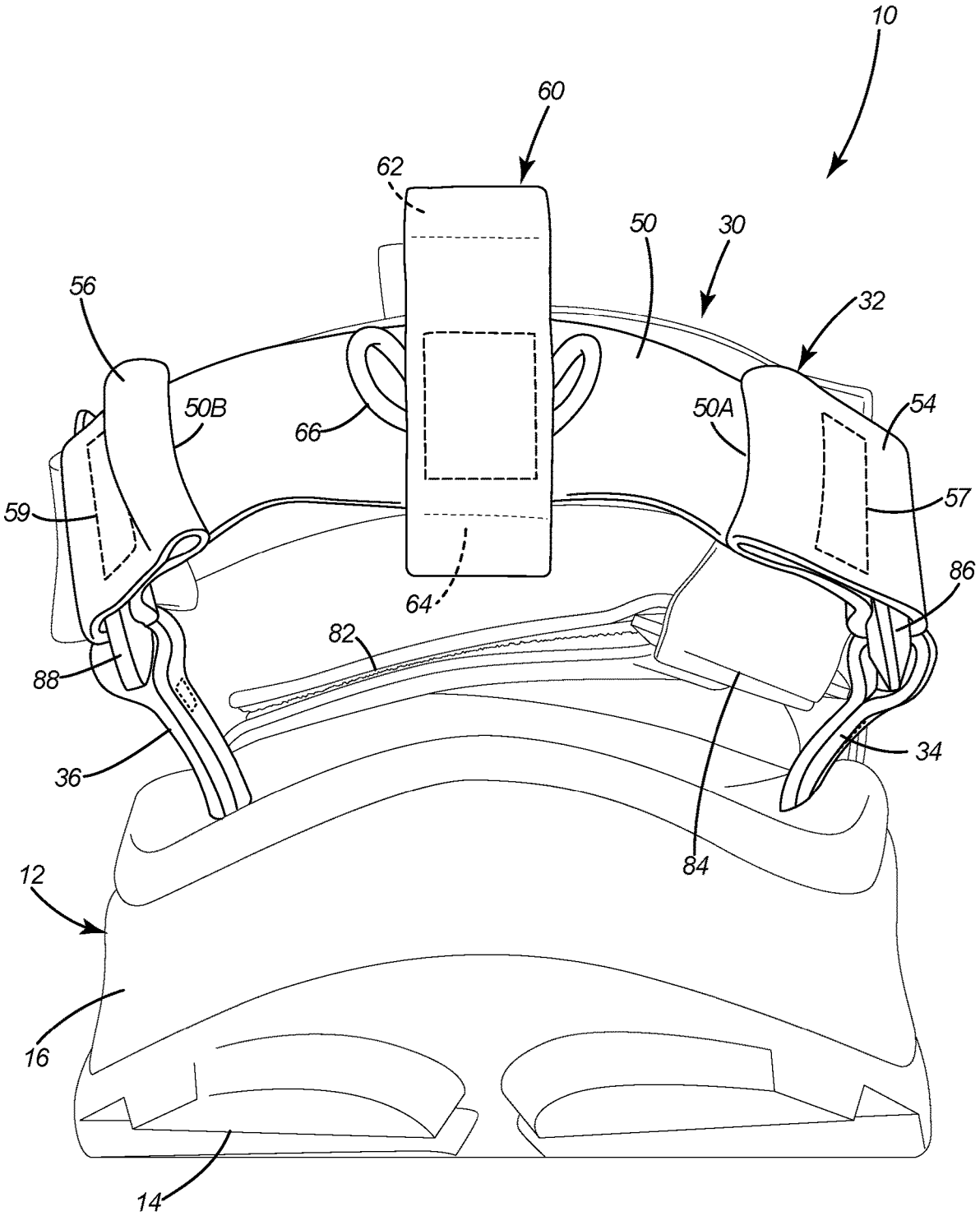
FIG. 3 is a rear view of the sandal with the second elastic closure element removed.
Figure 4:
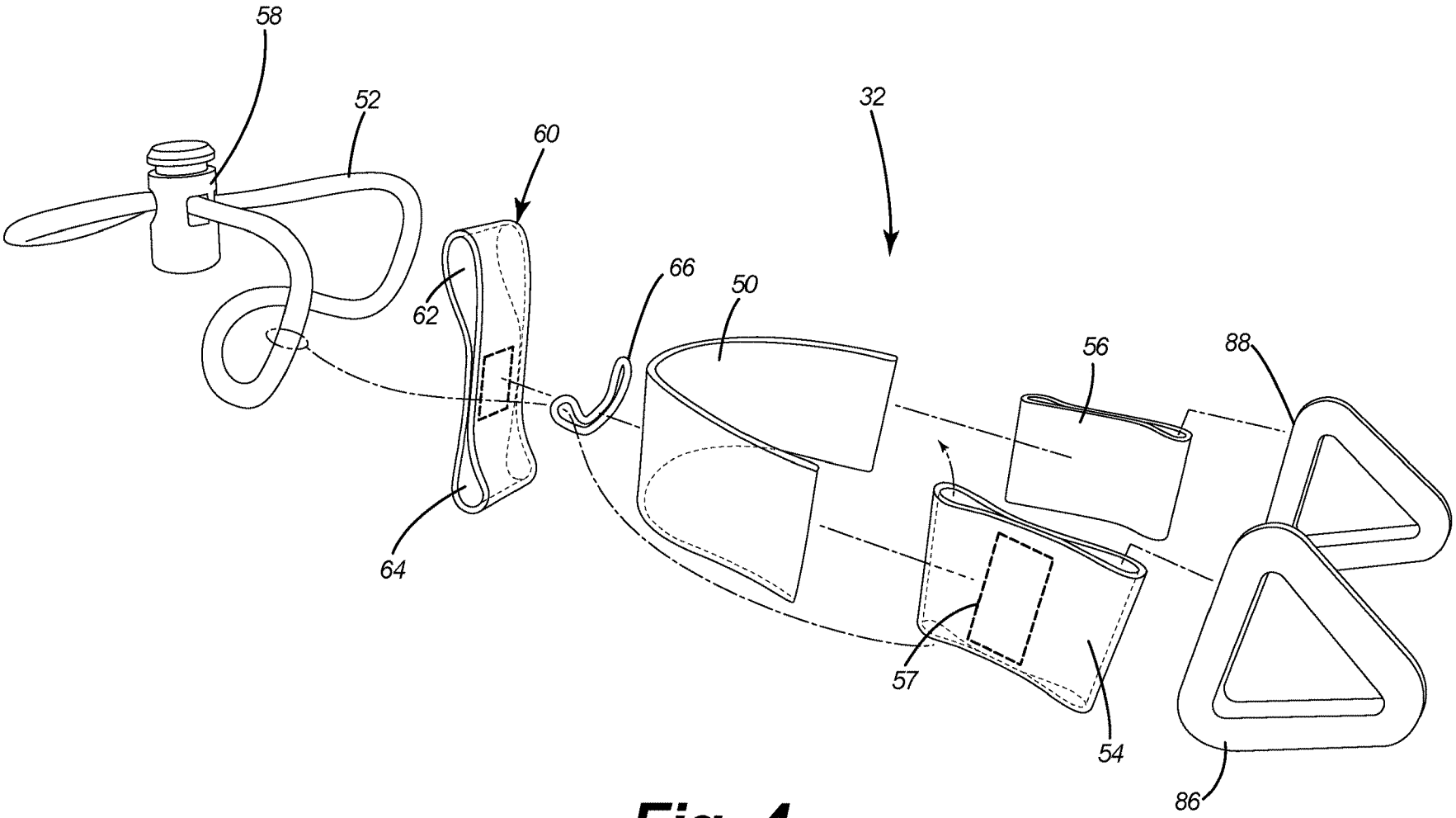
FIG. 4 is an exploded view of the adjustable elastic heel strap.
Figure 5:
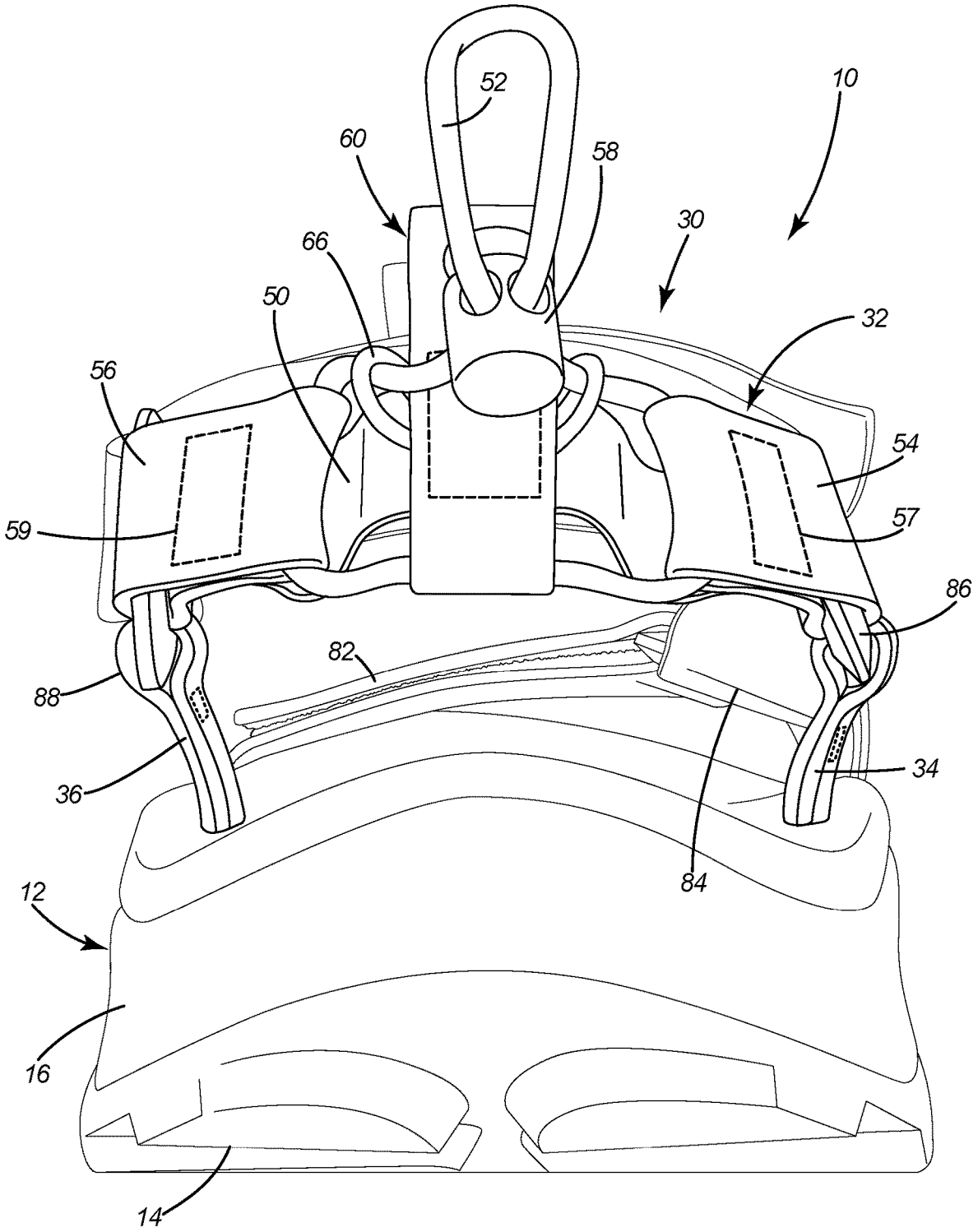
FIG. 5 is a rear view of the sandal showing the second elastic closure element in a tightened state.

Referring now to FIG. 2-5, the sandal 10 includes an adjustable elastic heel strap 32 that closes the rear of the sandal 10. In the illustrated embodiment, the heel strap 32 has a pair of elastic closure elements 50, 52 that work cooperatively to provide an adjustable elastic heel closure. FIG. 3 is a rear view of the sandal 10 with the second elastic closure element 52 removed to provide an unobstructed view of the first elastic closure element 50. The first elastic closure element 50 includes a first end 50A joined to the lateral ankle post 34 and a second end 50B joined to the medial ankle post 36. In this embodiment, the first elastic closure element 50 is fixed in length and is non-adjustable (though it may be adjustable in alternative applications). The first elastic closure element 50 of the illustrated embodiment is formed from a length of elastic webbing. The width of the elastic webbing may vary from application to application, but may be in the range of ¾ inch to 1 inch, or in the range of ½ inch to 1½ inch in typical applications. The width of the elastic webbing may be outside these ranges in some applications.

The first end 50A of the first elastic closure element 50 may be affixed directly or indirectly to the lateral ankle post 34 by stitching and a second end 50B may be affixed directly or indirectly to the medial ankle post 36 by stitching. In the illustrated embodiment, the heel strap 32 includes a separate webbing stub 54, 56 that extends from each ankle post 34, 36. For example, in this embodiment, the heel strap 32 includes a medial webbing stub 56 and a lateral webbing stub 54. In the illustrated embodiment, each webbing stub 54, 56 is formed by a short segment of webbing, such as a nylon webbing or other material with similar properties. A length of webbing is folded over and sewn back onto itself to form each webbing stubs 54, 56. The webbing stubs 54, 56 of the illustrated embodiment are formed from a non-elastic material, but one or both could be manufactured from elastic material in alternative applications. In the illustrated embodiment, the webbing stubs 54, 56 are affixed to the attachment rings 86, 88 on the ankle posts 34, 36. As shown, the webbing used to form each webbing stub may be fitted through the corresponding attachment ring 86, 88 folded over onto itself and then stitched together to secure the webbing stub 54, 56 to the attachment ring 86, 88. In other applications, the webbing stubs 54, 46 may eliminated with the first and second elastic closure elements 50, 52 being affixed directly to the ankle posts 34, 36 using alternative attachment structure or the webbing stubs 54, 56 may be replaced by corresponding structure that is integral with the ankle posts 34, 36.

Referring now to FIGS. 2-5, the first end 50A of the first elastic closure element 50 is joined to the medial webbing stub 56, for example, by bringing them into overlapping relationship and then stitching them together with stitching 57. Similarly, the second end 50B is joined to the lateral webbing stub 54, for example, again by bringing them into overlapping relationship and then stitching them together with stitching 59. In alternative applications, the first elastic closure element 50 may be joined to the webbing stubs 54, 56 or to the ankle posts 34, 36 using alternative attachment structure.

In the illustrated embodiment, the first elastic closure element 50 is arranged to directly engage the wearer's foot with the width of the first elastic closure element 50 being selected to provide a comfortable interface. For example, the first elastic closure element 50 may have a width in the range of ¾ inch to 1¼ inch, or in the range of ½ inch to 1½ inch. The first elastic closure element 50 may different widths and/or may vary in width along its length. Although not shown, the adjustable heel strap 32 may include a supplemental layer disposed inwardly of the first elastic closure element 50 to engage the wearer's foot. For example, a padding layer (not shown) with a soft inner surface may be disposed inwardly of the first elastic closure element 50.

The second elastic closure element 52 is adjustable in length and includes a first end 52A joined to the lateral ankle post 34 and a second end 52B joined to the medial ankle post 36. In use, the second elastic closure element 52 is adjustable by the user to selectively control the fit of the adjustable heel strap 32. For example, the second elastic closure element 52 may be lengthened (or loosened) to facilitate entry of the foot into the sandal 10 (see FIG. 2) and then shortened (or tightened) to secure the sandal 10 on the foot (see FIG. 5).

In the illustrated embodiment, the second elastic closure element 52 is disposed adjacent to the first elastic closure element 50 and is adjustable to vary the overall elastic tension in the adjustable heel strap 32. The second elastic closure element 52 of the illustrated embodiment extends between the medial ankle post 36 and the lateral ankle post 34 in parallel with the first elastic closure element 50.

In the illustrated embodiment, the second elastic closure element 52 includes an elastic cord that joins the lateral and medial ankle posts 34, 36. In this embodiment, the elastic cord 52 loops through the webbing stubs 54, 56 on opposite sides of the heel. For example, each webbing stub 54, 46 may be folded over and sewn onto itself to define a loop at the end of the webbing stub through which the elastic cord 52 passed. The elastic cord 52 of the illustrated embodiment is formed into a loop. More specifically, in the illustrated embodiment, the second elastic closure element 52 is formed by taking a length of elastic cord, passing it through the loops in the two webbing stubs 54, 56 (and the upper and lower retainers as discussed below) and then joining opposite free ends of the elastic cord 52 to one another with a coupling device (not shown) to provide a continuous loop. The elastic cord 52 may be positioned so that the coupling device (not shown) is hidden within the loop of one of the two webbing stubs 54, 56.

To provide adjustability, the elastic cord 52 of the illustrated embodiment is fitted with a cord lock 58 that allows the wearer to selectively adjust the effective size of the elastic cord 52. By decreasing the effective size of the elastic cord 52, the length of the heel strap 32 can be shortened and the elastic tension in the heel strap 32 can be increased. Conversely, by increasing the effective size of the elastic cord 52, the heel strap 32 can be lengthened and the elastic tension in the heel strap 32 can be reduced.

In the illustrated embodiment, the adjustable heel strap 32 also includes a heel pull 60 affixed to the approximate center of the first elastic closure element 50. For example, the heel pull 60 may be a section of webbing (e.g., nylon webbing) sewn to the first elastic closure element 50. The heel pull 60 of the illustrated embodiment is a length of webbing doubled over and sewn to itself and to the first elastic closure element 50. The illustrated heel pull 60 extends above and below the upper and lower edges of the first elastic closure element 50, but its configuration may vary from application to application. In the illustrated embodiment, the heel pull 60 is folded and sewn in such a way as to define an upper loop 62 that can be grasped and pulled by the user when manipulating the strap 32, for example, when pulling the heel strap 32 onto or off of the foot. The illustrated heel pull 62 is also folded and sewn in such as way as to define a lower loop 64 (or lower retainer) that can be used to help guide and retain the second elastic closure element 52. For example, the second elastic closure element 52 may be threaded through the lower loop 64 before it is joined into a continuous loop. In use, the lower loop 64 retains the second elastic closure element 52 so that it moves with the adjustable heel strap 32 and helps to prevent the second elastic closure 52 from sliding up or down onto wearer's foot. The adjustable heel strap 32 of the illustrated embodiment also includes an upper retainer 66 that holds the second elastic closure element 52. In this embodiment, the upper retainer 66 includes a length of cord that is secured to the heel pull 62. The cord of the upper retainer 66 may be configured to form small loops on opposite sides of the heel pull 62. The second elastic closure element 52 may be fitted through these two loops before the second elastic closure element 52 is joined into a continuous loop. As shown in FIG. 2, the cord lock 58 is positioned on the second elastic closure element 52 between the loops of the upper retainer 66. In use, the upper retainer 66 helps to hold the cord lock 58 in place making it easier to find and prevent the cord lock 58 from directly engaging the wearer's foot.

As can be seen, the illustrated embodiment of the present invention provides an adjustable elastic heel strap 32 that is selectively adjustable by the wearer. The first elastic closure element 50 has a fixed length and its characteristics (e.g., type of webbing, elasticity and length) can be selected to provide the adjustable heel strap 32 an initial length and an initial degree of elastic tension. For example, the characteristics of the first elastic closure element 50 may be tuned to allow the sandal to be easily put on and removed from the foot and to provide sufficient tension to hold the wearer's foot during casual use. The second elastic closure element 52 may be selectively adjusted by the user to vary the length and the elastic tension in the adjustable heel strap 32. The elastic cord 52 may be shortened to the desired degree and secured in place using the cord lock 58. For example, the degree to which the elastic cord 52 is shortened may depend on the anticipated activity level, with the elastic cord 52 be shortened to a greater degree to retain the sandal during greater levels of activity. The characteristics of the second elastic closure element 52 may be tuned to provide the desired range of adjustment available through the second elastic closure element 52.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A sandal comprising:

a sole having a heel end, an ankle region and a forefoot region;

a lateral ankle post extending upwardly from the sole in the ankle region forwardly of the heel end;

a medial ankle post extending upwardly from the sole in the ankle region forwardly of the heel end;

a strap configured to secure a wearer's foot to the sole in at least the forefoot region; and an adjustable heel strap disposed toward the heel end of the sole, the adjustable heel strap including;

a first elastic closure element, the first elastic closure element extending between the lateral ankle post and the medial ankle post, the first elastic closure element being a length of elastic webbing;

a second elastic closure element, the second elastic closure element extending between the lateral ankle post and the medial ankle post, the second elastic closure element being disposed adjacent to and outwardly of the first elastic closure element, the second elastic closure element having a selectively adjustable length, the second elastic closure element being an elastic cord; and a heel pull, the heel pull being secured to the first elastic closure element;

wherein the adjustable heel strap includes a lateral webbing stub affixed to the lateral ankle post and a medial webbing stub affixed to the medial ankle post; and wherein the second elastic closure element is coupled to the lateral webbing stub and to the medial webbing stub.

2. The sandal of claim 1 wherein the second elastic closure element is a loop having an upper segment and a lower segment; and wherein the adjustable heel strap includes an upper retainer that retains the upper segment of the loop and the lower retainer that retains the lower segment of the loop.

3. The sandal of claim 2 wherein the upper retainer includes a pair of loops disposed on opposite sides of the heel pull; and wherein the cord lock is positioned on a portion of the second elastic closure element disposed between the pair of loops.

4. The sandal of claim 3 wherein the heel pull is formed from a length of webbing, the lower retainer being defined by a loop in the length of webbing.

5. The sandal of claim 4 wherein each webbing stub is formed from a length of webbing, each webbing stub including a loop, the second elastic closure element extending through the loops in the webbing stubs.

6. An adjustable heel strap for an article of footwear comprising:

a first elastic closure element, the first elastic closure element having a first end configured to be attached to a footwear upper on a lateral side and a second end configured to be attached to a footwear upper on a medial side, the first elastic closure element having a first elastic tension; and a second elastic closure element, the second elastic closure element having a first end configured to be attached to a footwear upper on a lateral side and a second end configured to be attached to a footwear upper on a medial side, the second elastic closure element having a second elastic tension, the second elastic closure element being disposed adjacent to the first elastic closure element, the second elastic closure element having a selectively adjustable length; and wherein the second elastic closure element is a loop having an upper segment and a lower segment, the second elastic closure element being an elastic cord; and wherein the adjustable heel strap includes an upper retainer that retains the upper segment and a lower retainer that retains the lower segment.

7. The adjustable heel strap of claim 6 further including a heel pull affixed to the first elastic closure element; and wherein the upper retainer includes a pair of loops disposed on opposite sides of the heel pull; and wherein a cord lock is positioned on a portion of the second elastic closure element disposed between the pair of loops.

8. The adjustable heel strap of claim 7 wherein the heel pull is formed from a length of webbing, the lower retainer being defined by a loop in the length of webbing of the heel pull.

9. The adjustable heel strap of claim 8 further including a lateral webbing stub affixed to a footwear upper on a lateral side and a medial webbing stub affixed to a footwear upper on a medial side; and wherein each webbing stub is formed from a length of webbing, each webbing stub including a loop, the second elastic closure element extending through the loops in the webbing stubs.

10. A sandal comprising:

a sole having a heel end, an ankle region and a forefoot region;

a lateral ankle post extending upwardly from the sole in the ankle region forwardly of the heel end;

a medial ankle post extending upwardly from the sole in the ankle region forwardly of the heel end;

a forefoot strap configured to secure a wearer's foot to the sole in the forefoot region;

an ankle strap configured to secure the wearer's foot to the sole in the ankle region; and an adjustable heel strap disposed toward the heel end of the sole, the adjustable heel strap including;

a first elastic closure element, the first elastic closure element extending between the lateral ankle post and the medial ankle post, the first elastic closure element being a length of elastic webbing;

a second elastic closure element, the second elastic closure element extending between the lateral ankle post and the medial ankle post, the second elastic closure element being disposed adjacent to and outwardly of the first elastic closure element, the second elastic closure element being manufactured from an elastic cord arranged in a loop; and a cord lock operatively engaged with the second elastic closure, the cord lock disposed on a folded portion of the loop, the cord lock being selectively movable along the folded portion of the loop to vary a size of the loop and vary an effective length of the second elastic closure element; and wherein the adjustable heel strap includes a heel pull, the heel pull being affixed to the first elastic closure element, the heel pull including an upper retainer retaining a first portion of the loop and a lower retainer retaining a second portion of the loop.

* * * * *